US005993732A

United States Patent [19]

Nakayama et al.

[11] Patent Number: 5,993,732

[45] Date of Patent: Nov. 30, 1999

[54] METHOD FOR MANUFACTURING A RARE EARTH MAGNETIC POWDER HAVING HIGH MAGNETIC ANISOTROPY

[75] Inventors: Ryoji Nakayama; Yoshinari Ishii; Norihito Fukatsu; Koichiro Morimoto, all of Ohmiya, Japan

[73] Assignee: Mitsubishi Materials Corporation, Tokyo, Japan

[21] Appl. No.: 09/114,254

[22] Filed: Jul. 13, 1998

[51] Int. Cl.[6] ..... B22F 1/00; B22F 3/12; B22F 3/14

[52] U.S. Cl. ..... 419/31; 419/36; 419/48; 419/49; 148/513

[58] Field of Search ..... 419/48, 49, 31, 419/36; 148/513

[56] References Cited

U.S. PATENT DOCUMENTS

| | | | |
|---|---|---|---|
| 5,354,040 | 10/1994 | Nakayama et al. . | |
| 5,505,794 | 4/1996 | Nakayama et al. . | |
| 5,643,491 | 7/1997 | Honkura et al. . | |
| 5,851,312 | 12/1998 | Honkura et al. | 148/122 |
| 5,865,873 | 2/1999 | Sekine et al. | 75/348 |
| 5,886,070 | 3/1999 | Honkura et al. | 523/300 |
| 5,886,077 | 3/1999 | Takahashi et al. | 524/403 |

FOREIGN PATENT DOCUMENTS

| | | |
|---|---|---|
| 3-129702 | 6/1991 | Japan . |
| 7-76708 | 3/1995 | Japan . |
| 7-68561 | 7/1995 | Japan . |

*Primary Examiner*—Daniel J. Jenkins

*Attorney, Agent, or Firm*—Oblon, Spivak, McClelland, Maier & Neustadt, P.C.

[57] ABSTRACT

An R—T—M alloy material, wherein R is at least one rare earth metal including Y, T is Fe or an Fe component partially replaced by Co or Ni, M is B or a B component partially replaced by C as primary components is prepared by heating the alloy at a temperature from room temperature to a specific temperature of less than 500° C. in a non-oxidizing atmosphere and holding it at the given temperature, if necessary; performing hydrogenation by holding the alloy in a hydrogen atmosphere or a mixed gas atmosphere of hydrogen and an inert gas at a specific temperature in the range of 500–1,000° C.; medial annealing the alloy by holding the R—T—M alloy after the hydrogenation step in an inert gas atmosphere at a specific temperature in the range of 500–1,000° C.; and dehydrogenating the alloy by holding the alloy in a vacuum of less than 1 Torr for dehydrogenation, and then cooling the alloy.

16 Claims, 1 Drawing Sheet

METHOD FOR MANUFACTURING A RARE EARTH MAGNETIC POWDER HAVING HIGH MAGNETIC ANISOTROPY

BACKGROUND OF THE INVENTION

1. Field of the Invention

The present invention relates to a method for manufacturing a rare earth magnetic powder having high magnetic anisotropy, and to a method for manufacturing a rare earth magnet using the rare earth magnetic powder.

2. Description of the Background

A method for manufacturing a rare earth magnetic powder is known as described in, for example, Japanese Patent Laid-Open No. 2-04901, in which an alloy material (hereinafter referred to as an R—T—M alloy material) containing at least one rare earth metal including Y (hereinafter referred to as R), Fe or an Fe component, which is partly replaced by Co or Ni (hereinafter referred to as T), and B or a B component, which is partly replaced by C (hereinafter referred to as M) as primary components, and an alloy material (hereinafter referred to as an R—T—M—A alloy material) comprising the R—T—M alloy material and 0.001–5 atomic percent of at least one element selected from the group consisting of Si, Ga, Zr, Nb, Mo, Hf, Ta, W, Al, Ti and V (hereinafter referred to as A) is homogenized, if necessary, in an Ar gas atmosphere at a temperature of 600–1,200° C. The alloy material is heated 500–1,000° C. in a hydrogen atmosphere or a mixed gas atmosphere of hydrogen and an inert gas and held at the specific temperature for a hydrogenation treatment. The alloy is dehydrogenated at a temperature of 500–1,000° C. in a vacuum, cooled and then pulverized.

In recent years, the demand for rare earth magnetic powders having higher magnetic anisotropy than conventional powders has increased in order to achieve further miniaturization and higher performance of magnetic parts in the electric and electronic fields. No rare earth magnetic powder having sufficiently high magnetic anisotropy for these purposes has yet been obtained.

SUMMARY OF THE INVENTION

Accordingly, one object of the present invention is to provide a method of manufacturing a rare earth magnetic powder having higher magnetic anisotropy than conventional powders.

Briefly, this object and other objects of the present invention as hereinafter will become more readily apparent can be attained by a method of producing a rare earth magnetic powder in which:

(a) A rare earth magnetic powder having a recrystallization texture of fine $R_2T_{14}M$ intermetallic compound phases and having a higher magnetic anisotropy can be produced by heating the R—T—M or R—T—M—A alloy material from room temperature to a specific temperature of less than 500° C. in a non-oxidizing atmosphere and holding it at the specific temperature, performing a hydrogenation treatment by holding the R—T—M or R—T—M—A alloy material at a specific temperature in a range of 500–1,000° C. in a hydrogen atmosphere or a mixed gas atmosphere of hydrogen and an inert gas to promote phase transformation by hydrogenation, performing medial annealing by holding the R—T—M or R—T—M—A alloy material after the hydrogenation treatment at a specific temperature in a range of 500–1,000° C. in an inert gas atmosphere, and performing dehydrogenation by holding the R—T—M or R—T—M—A alloy material at a specific temperature in a range of 500–1,000° C. in a vacuum at a final pressure of less than 1 Torr to promote phase transformation by forcibly causing the release of hydrogen from the R—T—M alloy material.

(b) It is preferred that the R—T—M or R—T—M—A alloy material be homogenized by holding it at a temperature of 600–1,200° C. in a vacuum or under an Ar gas atmosphere.

(c) It is preferred that the medial annealing at a given temperature in a range of 500–1,000° C. of the R—T—M or R—T—M—A alloy material after the hydrogenation treatment be performed in an inert gas atmosphere with a pressure in a range of 0.5–11 atm.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
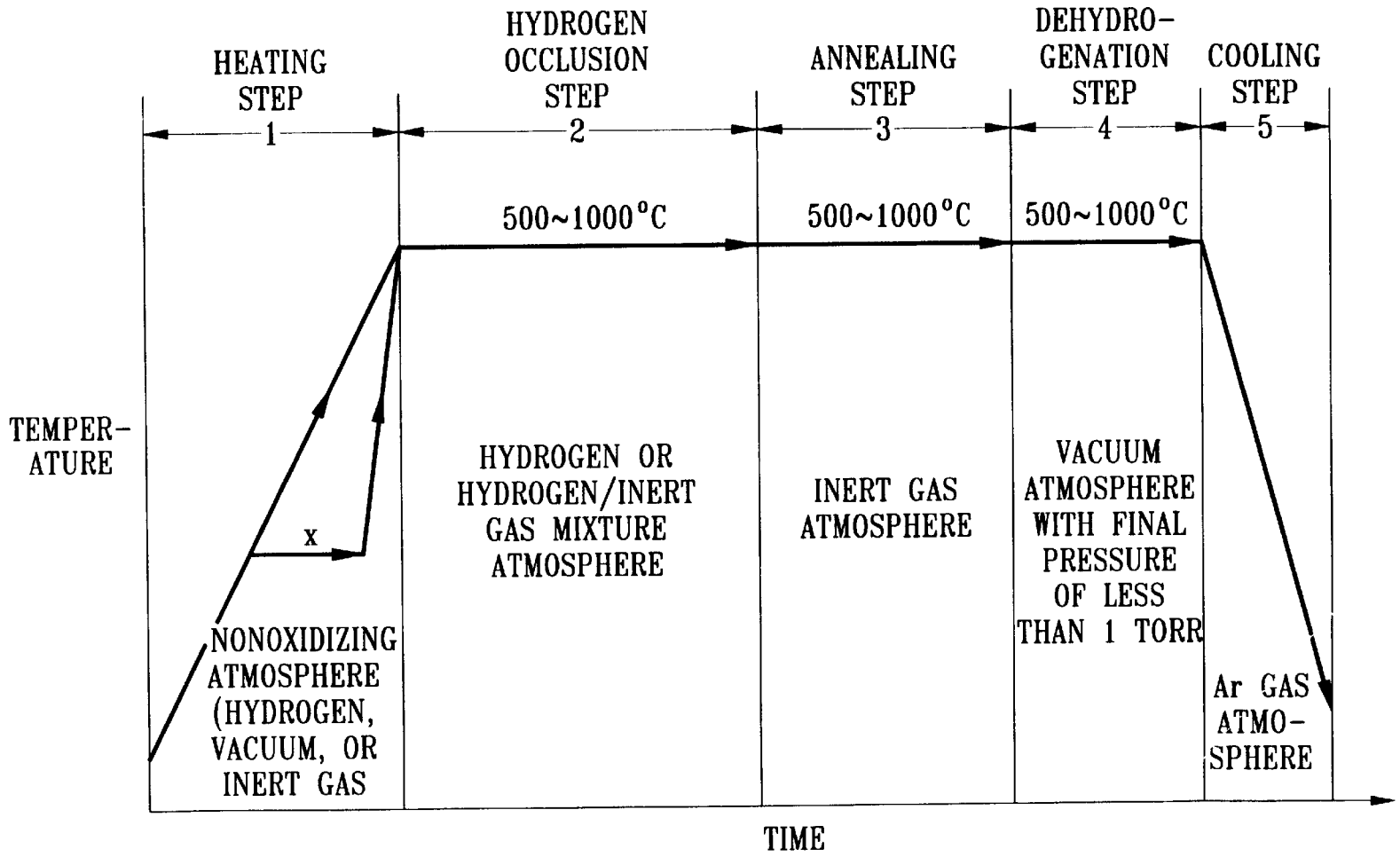
FIG. 1 is a schematic illustration of a heat treatment pattern of a method of manufacturing a rare earth magnetic powder of the present invention.

The present invention has been completed based on these findings. Accordingly, one(1) embodiment of the invention is a method for manufacturing a rare earth magnetic powder having a recrystallization texture of fine $R_2T_{14}M$ intermetallic compound phases and having high magnetic anisotropy, comprising:

heating an R—T—M alloy material from room temperature to a specific temperature of less than 500° C. in a non-oxidizing atmosphere and optionally holding the alloy at this temperature;

performing a hydrogenation treatment on the R—T—M alloy material by holding the R—T—M alloy material at a specific temperature in the range of 500–1,000° C. in a hydrogen atmosphere or a mixed gas atmosphere of hydrogen and an inert gas to promote phase transformation of the R—T—M alloy material by hydrogenation;

performing medial annealing by holding the R—T—M alloy material after the hydrogenation treatment at a specific temperature in the range of 500–1,000° C. in an inert gas atmosphere; and performing dehydrogenation by holding the R—T—M alloy material at a specific temperature in the range of 500–1,000° C. in a vacuum of a final pressure of less than 1 Torr to promote phase transformation in the R—T—M alloy material by forcibly releasing hydrogen from the R—T—M alloy material, followed by cooling and pulverizing.

In a second embodiment(2) of the invention a rare earth magnetic powder having a recrystallization texture of fine $R_2T_{14}M$ intermetallic compound phases and having high magnetic anisotropy is manufactured, by:

heating an R—T—M alloy material, which is homogenized at a temperature of 600–1,200° C. in a vacuum or Ar gas atmosphere, from room temperature to a specific temperature of less than 500° C. in a non-oxidizing atmosphere and optionally holding the alloy at this temperature;

performing hydrogenation of the R—T—M alloy material by holding the R—T—M alloy material at a specific temperature in a range of 500–1,000° C. in a hydrogen atmosphere or a mixed gas atmosphere of hydrogen and an inert gas to promote phase transformation of the R—T—M alloy material by hydrogenation;

performing medial annealing by holding the R—T—M alloy material after the hydrogenation treatment at a specific temperature in the range of 500–1,000° C. in an inert gas atmosphere; and performing dehydrogenation by holding the R—T—M alloy material at a specific temperature in the range of 500–1,000° C. in a vacuum of a final pressure of less than 1 Torr to promote phase transformation in the R—T—M alloy material by forcibly releasing hydrogen from the R—T—M alloy material, followed by cooling and pulverizing.

In a third embodiment(3) of the invention a rare earth magnetic powder having a recrystallization texture of fine $R_2T_{14}M$ intermetallic compound phases and having high magnetic anisotropy is manufactured by:

heating an R—T—M—A alloy material from room temperature to a specific temperature of less than 500° C. in a non-oxidizing atmosphere and optionally holding the alloy at this temperature;

performing hydrogenation of the R—T—M—A alloy material by holding the R—T—M—A alloy material at a specific temperature in the range of 500–1,000° C. in a hydrogen atmosphere or a mixed gas atmosphere of hydrogen and an inert gas to promote phase transformation of the R—T—M—A alloy material by hydrogenation;

performing medial annealing by holding the R—T—M—A alloy material after the hydrogenation treatment at a specific temperature in the range of 500–1,000° C. in an inert gas atmosphere; and performing dehydrogenation by holding the R—T—M—A alloy material at a specific temperature in the range of 500–1,000° C. in a vacuum of a final pressure of less than 1 Torr to promote phase transformation in the R—T—M—A alloy material by forcibly releasing hydrogen from the R—T—M—A alloy material, followed by cooling and pulverizing;

In a fourth embodiment (4) of the invention a rare earth magnetic powder having a recrystallization texture of fine $R_2T_{14}M$ intermetallic compound phases and having high magnetic anisotropy is manufactured by;

heating the R—T—M—A alloy material, which is homogenized at a temperature of 600–1,200° C. in a vacuum or Ar gas atmosphere, from room temperature to a specific temperature of less than 500° C. in a non-oxidizing atmosphere and optionally holding the alloy at this temperature;

performing hydrogenation of the R—T—M—A alloy material by holding the R—T—M—A alloy material at a specific temperature in the range of 500–1,000° C. in a hydrogen atmosphere or a mixed gas atmosphere of hydrogen and an inert gas to promote phase transformation of the R—T—M—A alloy material by hydrogenation;

performing medial annealing by holding the R—T—M—A alloy material after the hydrogenation treatment at a specific temperature in the range of 500–1,000° C. in an inert gas atmosphere; and performing dehydrogenation by holding the R—T—M—A alloy material at a specific temperature in the range of 500–1,000° C. in a vacuum of a final pressure of less than 1 Torr to promote phase transformation in the R—T—M—A alloy material by forcibly releasing hydrogen from the R—T—M—A alloy material, followed by cooling and pulverizing.

In a fifth embodiment (5) of the invention a rare earth magnetic powder having a recrystallization texture of fine $R_2T_{14}M$ intermetallic compound phases and having high magnetic anisotropy described in embodiments (1)–(4) is subjected to medial annealing in an inert gas atmosphere an atmosphere having a pressure in a range of 0.5–11 atm.

In one embodiment of manufacturing a rare earth magnet, a rare earth magnetic powder, which is produced by one of the method embodiments (1)–(5) of the present invention and has a recrystallization texture of fine $R_2T_{14}M$ intermetallic compound phases and high magnetic anisotropy, is combined with an organic binder or a metallic binder, or by hot-pressing or hot-isostatic pressing the powder at a temperature of 600–900° C.

In another embodiment of manufacture of a rare earth magnet, a green compact of an embodiment of a rare earth magnetic powder (1)–(5) above is prepared, and then the green compact is hot-pressed or hot-isostatic pressed at a temperature of 600–900° C.

The method for manufacturing the rare earth magnetic powder of the present invention has, as a significant aspect, a medial annealing step in which the alloy material is held at a specific temperature in the range of 500–1,000° C. in an inert gas atmosphere having a pressure of 0.5–11 atm between the hydrogenation step and the dehydrogenation step.

The medial annealing step after the hydrogenation treatment causes a change in the texture in the alloy in which the phases are decomposed by occlusion of hydrogen in the hydrogenation treatment, and the following dehydrogenation treatment forms a rare earth magnetic powder having fine recrystallization textures in which the c axis in the $R_2T_{14}M$ intermetallic compound phase is further oriented in one direction. Thus, the rare earth magnetic powder has a higher magnetic anisotropy and coercive force than rare earth magnetic powders which are produced by conventional methods.

The method for making the rare earth magnetic powder having a recrystallization texture of fine $R_2T_{14}M$ intermetallic compound phases and having high magnetic anisotropy in accordance with the present invention is now described with reference to the drawing.

FIG. 1 shows a heat treatment pattern in the method for manufacturing the rare earth magnetic powder having a recrystallization texture of fine $R_2T_{14}M$ intermetallic compound phases and having high magnetic anisotropy of the present invention. That is, the relationship between the temperature, the time and the atmosphere in the heating step, the hydrogenation step, the medial annealing step, and the dehydrogenation step, and the cooling step is shown. In FIG. 1, numerals ①, ②, ③, ④ and ⑤ represent the heating step, the hydrogenation step, the medial annealing step, and the dehydrogenation step, and the cooling step, respectively.

In the heating step ①, the R—T—M or R—T—M—A alloy material is heated to a temperature from room temperature to a specific temperature of less than 500° C. in a non-oxidizing atmosphere (for example, a hydrogen gas atmosphere, a vacuum, or an inert gas atmosphere), or is heated and held at a specific temperature x (for example, 100° C.) of less than 500° C. and then reheated.

In the hydrogenation step ②, the R—T—M or R—TM—A alloy material is held in a hydrogen atmosphere or a mixed gas atmosphere of hydrogen and an inert gas at 500–1,000° C. to promote phase transformation in the alloy material by hydrogenation.

In the medial annealing step ③, the R—T—M or R—T—M—A alloy material after the hydrogenation treatment is held in an inert gas atmosphere, preferably, at a pressure of 0.5–11 atm, and more preferably 0.5–2 atm, at a specific temperature in a range of 500–1,000° C., preferably, 650–950° C., and more preferably 750–900° C., for a specified time. The medial annealing step ③ is most preferably performed in an Ar gas atmosphere with a pressure of 0.5–2 atm at a temperature of 750–900° C. for 1–30 minutes. The introduction of the inert gas in the medial annealing step ③ is preferred as a substitute for the hydrogen gas atmosphere or the mixed gas atmospheres of hydrogen and an inert gas in the hydrogenation step ②. The medial annealing step ③ is the most characteristic step in the present invention. When the medial annealing step ③ is performed after the hydrogenation step, the texture of the alloy in which the phase is decomposed by hydrogenation changes. Upon the subsequent dehydrogenation treatment, a rare earth magnetic powder having a fine recrystallization texture, in which the c axis of the $R_2Tm_{14}M$ intermetallic compound is further oriented in one direction, is obtained. Thus, the magnetic powder has higher magnetic anisotropy and coercive force than the rare earth magnetic powders produced by conventional processes.

In the dehydrogenation step ④, the R—T—M or R—T—M—A alloy is held at a temperature in the range of 500–1,000° C. in a vacuum with a final pressure of less than 1 Torr to forcibly release hydrogen which is not released in the medial annealing step ③. After the dehydrogenation step ④, the alloy material is cooled to room temperature in the cooling step ⑤ using inert gas (Ar gas).

Having now generally described the invention, a further understanding can be obtained by reference to certain specific examples which are provided herein for purpose of illustration only and are not intended to be limiting unless otherwise specified.

EXAMPLE 1

Melts were prepared in a high frequency vacuum-melting furnace and cast to produce ingots a to j of R—T—M or R—T—M—A alloy materials having the compositions shown in Table 1. Each of the ingots of the resulting R—T—M or R—T—M—A alloy materials was shaped into a block with a side of 10 mm or less. Ingot blocks were heated from room temperature to specific temperatures or heated and held at the specific temperatures shown in Tables 2–5. The blocks were subjected to hydrogenation treatment, to medial annealing, and to dehydrogenation under the conditions shown in Tables 2–5, forcibly cooled to room temperature with Ar gas and then pulverized to produce a rare earth magnetic powder having a particle size of 300 $\mu$m or less. Invention Methods 1–28 of the present invention, Comparative Methods 1–2 for comparison, and Conventional Methods 1–10 were conducted in such a manner.

To the rare earth magnetic powder of each of Invention Methods 1–28, Comparative Methods 1–2 and Conventional Methods 1–10, 3 percent by weight of epoxy resin was added. The materials were kneaded and compressed in a magnetic field of 20 kOe to form green compacts. The green compacts were thermoset in an oven at 150° C. for 2 hours to form bonded magnets with a density of 6.0–6.1 g /cm$^3$. The magnetic characteristics of the resulting bonded magnets are shown in Tables 6–9.

Anisotropic green compacts were prepared in a magnetic field from the rare earth magnetic powders of Invention Methods 1–28, Comparative Methods 1–2 and Conventional Methods 1–10, placed into a hot press, and hot-pressed at a temperature of 750° C. and a pressure 0.6 Ton/cm$^2$ for 1 minute in Ar gas so that the green compacts were compressed in the direction in which the magnetic field is applied. Hot press magnets with densities of 7.5–7.7 g/cm$^3$ were prepared by quenching the compressed compacts. The magnetic characteristics of the resulting hot press magnets are shown in Tables 6–9.

TABLE 1

| Type | Composition (atomic %) (the balance is Fe) |
|---|---|
| Ingot | |
| a | Nd:12.0%, Co:16.5%, B:6.2%, Zr:0.2%, Al:0.5% |
| b | Nd:11.0%, Dy:1.2%, Pr:0.2%, Co:5.7%, B:6.0%, Zr:0.1%, Ti:0.3% |
| c | Nd:12.0%, Pr:0.3%, Co:20.0%, B:6.5%, C:0.05%, Zr:0.2%, Ga:0.5% |
| d | Nd:12.0%, Dy:0.6%, B:7.0%, Hf:0.1%, Nb:0.2%, Si:0.1% |
| e | Nb:6.5%, Pr:6.0%. Co:18.7%. B:5.8%, Hf:0.1%, Ta:0.2%, Ga:0.5% |
| f | Nd:11.5%, Dy:0.6%, Pr:0.3%, Co:9.0%, B:6.0%, Zr:0.1%, Ga:0.3% |
| g | Nd:12.3%, Ce:0.1%, Pr:0.2%, Co:16.5%, B:6.2%, Zr:0.5%, Ga:0.5% |
| h | Nd:14.1%, La:0.1%, Pr:0.2%; Co:20.1%, B:6.5%, Nb:0.5%, Ga:1.0% |
| i | Nd:12.1%, Pr:0.5%, Co:18.0%, B:6.0%, C:0.1% |
| j | Nd:11.2%, Dy:0.3%, Pr:0.3%, Co:11.7%, Ni:1.0%, B:5.5%, C:0.2%, Zr:0.05%, Mo:0.2%, Al:0.7% |

TABLE 2

| | | Heating | Hydrogen occulusion | | | Medial annealing | | | Dehydrogenation | | |
|---|---|---|---|---|---|---|---|---|---|---|---|
| Type | Ingot | Atmosphere from room temp. to less than 500° C. | $H_2$ press (atm) | Holding temp. (° C.) | Holding time (min.) | Ar press (atm) | Holding temp. (° C.) | Holding time (min.) | Final press (Torr) | Holding temp. (° C.) | Holding time (hr.) |
| Invention's Method | | | | | | | | | | | |
| 1 | a | Vacuum from room temp. to 100° C., and $H_2$ of 1 atm. from 100° C. to 500° C. | 1 | 850 | 20 | 1 | 850 | 10 | 0.98 | 830 | 40 |
| 2 | b | | 5 | 850 | 20 | 1 | 850 | 10 | 0.98 | 830 | 40 |

TABLE 2-continued

| Type | Ingot | Heating: Atmosphere from room temp. to less than 500° C. | Hydrogen occulusion: $H_2$ press (atm) | Hydrogen occulusion: Holding temp. (° C.) | Hydrogen occulusion: Holding time (min.) | Medial annealing: Ar press (atm) | Medial annealing: Holding temp. (° C.) | Medial annealing: Holding time (min.) | Dehydrogenation: Final press (Torr) | Dehydrogenation: Holding temp. (° C.) | Dehydrogenation: Holding time (hr.) |
|---|---|---|---|---|---|---|---|---|---|---|---|
| 3 | c | Vacuum from room | 1 | 830 | 60 | 1.2 | 840 | 5 | 0.05 | 820 | 50 |
| 4 | d | temp. to 200° C., and | 1 | 830 | 60 | 1.2 | 840 | 5 | 0.05 | 820 | 50 |
| 5 | e | $H_2$ 1 atm. from 200° C. to 500° C. | 1 | 830 | 60 | 1.2 | 840 | 5 | 0.5 | 820 | 50 |
| 6 | f | Vacuum from room | 2 | 850 | 120 | 1 | 850 | 10 | 0.05 | 850 | 60 |
| 7 | g | temp. to 100° C., and | 1 | 850 | 120 | 2 | 850 | 10 | 0.2 | 850 | 60 |
| 8 | h | $H_2$ of 1 atm. from | 1 | 850 | 120 | 2 | 850 | 10 | 0.02 | 850 | 60 |
| 9 | i | 100° C. to 500° C. | 1 | 850 | 120 | 1 | 850 | 10 | 0.2 | 850 | 60 |
| 10 | j | | 1.5 | 850 | 120 | 1 | 850 | 10 | 0.001 | 850 | 60 |

TABLE 3

| Type | Ingot | Heating: Atmosphere from room temp. to less than 500° C. | Hydrogen occulusion: $H_2$ press (atm) | Hydrogen occulusion: Holding temp. (° C.) | Hydrogen occulusion: Holding time (min.) | Medial annealing: Ar press (atm) | Medial annealing: Holding temp. (° C.) | Medial annealing: Holding time (min.) | Dehydrogenation: Final press (Torr) | Dehydrogenation: Holding temp. (° C.) | Dehydrogenation: Holding time (hr.) |
|---|---|---|---|---|---|---|---|---|---|---|---|
| Invention's Method | | | | | | | | | | | |
| 11 | a | Vacuum from room | 1 | 820 | 30 | 1 | 820 | 10 | 0.05 | 820 | 40 |
| 12 | b | temp. to 100° C., | 3 | 880 | 60 | 1 | 850 | 10 | 0.01 | 850 | 30 |
| 13 | c | hydrogen of 1 atm at | 0.8 | 860 | 10 | 2 | 860 | 5 | 0.02 | 840 | 50 |
| 14 | d | 100° C. for 30 min., | 2 | 800 | 30 | 2 | 820 | 20 | 0.02 | 830 | 60 |
| 15 | e | and heating in $H_2$ of 1 atm to less than 500° C. | 1 | 920 | 120 | 1 | 850 | 10 | 0.01 | 800 | 60 |
| 16 | f | Heating in Ar from | 2 | 800 | 30 | 2 | 820 | 20 | 0.005 | 770 | 60 |
| 17 | g | room temp. to | 0.5 | 890 | 60 | 3 | 770 | 60 | 0.01 | 800 | 50 |
| 18 | h | 200° C., Ar at | 1 | 840 | 60 | 1 | 840 | 20 | 0.002 | 770 | 60 |
| 19 | i | 200° C. for 60 min., | 0.7 | 780 | 10 | 0.5 | 850 | 10 | 0.50 | 850 | 30 |
| 20 | j | and heating in Ar to less than 500° C. | 1 | 800 | 120 | 0.8 | 800 | 40 | 0.1 | 800 | 50 |

TABLE 4

| Type | Ingot | Heating: Atmosphere from room temp. to less than 500° C. | Hydrogen occulusion: $H_2$ press (atm) | Hydrogen occulusion: Holding temp. (° C.) | Hydrogen occulusion: Holding time (min.) | Medial annealing: Ar press (atm) | Medial annealing: Holding temp. (° C.) | Medial annealing: Holding time (min.) | Dehydrogenation: Final press (Torr) | Dehydrogenation: Holding temp. (° C.) | Dehydrogenation: Holding time (hr.) |
|---|---|---|---|---|---|---|---|---|---|---|---|
| Invention's Method | | | | | | | | | | | |
| 21 | a | Vacuum from room | 1 | 830 | 60 | 0.3 | 840 | 5 | 0.05 | 820 | 50 |
| 22 | b | temp. to 200° C., | 1 | 830 | 60 | 0.5 | 840 | 5 | 0.05 | 820 | 50 |
| 23 | c | $H_2$ of 1 atm. | 1 | 830 | 60 | 5.0 | 840 | 5 | 0.05 | 820 | 50 |
| 24 | d | at 200° C. for | 1 | 830 | 60 | 11.0 | 840 | 5 | 0.05 | 820 | 50 |
| 25 | e | 30 min., and | 1 | 830 | 60 | 1.2 | 840 | 300 | 0.05 | 820 | 50 |
| 26 | f | $H_2$ of 1 atm. | 1 | 830 | 60 | 1.2 | 840 | 30 | 0.05 | 820 | 50 |
| 27 | g | from 200° C. | 1 | 830 | 60 | 1.2 | 840 | 5 | 0.05 | 820 | 50 |
| 28 | h | to 500° C. | 1 | 830 | 60 | 1.2 | 840 | 0.5 | 0.05 | 820 | 50 |
| Comparative Method | | | | | | | | | | | |
| 1 | i | | 1 | 830 | 60 | 13.0* | 840 | 5 | 0.05 | 820 | 50 |
| 2 | j | | 1 | 830 | 60 | 1.2 | 1050* | 0.5 | 0.05 | 820 | 50 |

TABLE 5

| Type | Ingot | Heating: Atmosphere from room temp. to less than 500° C. | Hydrogen occulusion: $H_2$ press (atm) | Hydrogen occulusion: Holding temp. (° C.) | Hydrogen occulusion: Holding time (min.) | Medial annealing: Ar press (atm) | Medial annealing: Holding temp. (° C.) | Medial annealing: Holding time (min.) | Dehydrogenation: Final press (Torr) | Dehydrogenation: Holding temp. (° C.) | Dehydrogenation: Holding time (hr.) |
|---|---|---|---|---|---|---|---|---|---|---|---|
| Conventional Method | | | | | | | | | | | |
| 1 | a | Vacuum from room | 1 | 850 | 20 | — | — | — | 0.98 | 830 | 40 |
| 2 | b | temp. to 100° C., and | 5 | 850 | 20 | — | — | — | 0.98 | 830 | 40 |
| | | $H_2$ of 1 atm. from 10° C. to 500° C. | | | | | | | | | |
| 3 | c | Vacuum from room | 1 | 830 | 60 | — | — | — | 0.05 | 820 | 50 |
| 4 | d | temp. to 200° C., and | 1 | 830 | 60 | — | — | — | 0.05 | 820 | 50 |
| 5 | e | $H_2$ of 1 atm. from 200° C. to 500° C. | 1 | 830 | 60 | — | — | — | 0.5 | 820 | 50 |
| 6 | f | Vacuum from room | 2 | 850 | 120 | — | — | — | 0.05 | 850 | 60 |
| 7 | g | temp. to 100° C., and | 1 | 850 | 120 | — | — | — | 0.2 | 850 | 60 |
| 8 | h | $H_2$ of 1 atm. from | 1 | 850 | 120 | — | — | — | 0.02 | 850 | 60 |
| 9 | i | 100° C. to 500° C. | 1 | 850 | 120 | — | — | — | 0.2 | 850 | 60 |
| 10 | j | | 1.5 | 850 | 120 | — | — | — | 0.001 | 850 | 60 |

TABLE 6

| Type | Bonded Magnet: Br (kG) | Bonded Magnet: iHc (kOe) | Bonded Magnet: BHmax (MGOe) | Hot pressed magnet: Br (kG) | Hot pressed magnet: iHc (kOe) | Hot pressed magnet: BHmax (MGOe) |
|---|---|---|---|---|---|---|
| Invention's Method | | | | | | |
| 1 | 10.1 | 11.0 | 22.1 | 12.6 | 10.7 | 36.1 |
| 2 | 8.9 | 25.4 | 18.3 | 11.1 | 25.1 | 28.6 |
| 3 | 10.2 | 11.7 | 23.0 | 12.8 | 11.4 | 37.6 |
| 4 | 9.1 | 20.3 | 18.6 | 11.4 | 18.7 | 30.2 |
| 5 | 9.8 | 10.7 | 20.7 | 12.3 | 10.3 | 33.8 |
| 6 | 9.4 | 21.6 | 20.3 | 11.8 | 20.3 | 33.0 |
| 7 | 10.1 | 11.6 | 22.5 | 12.6 | 11.7 | 35.1 |
| 8 | 9.7 | 13.1 | 20.2 | 12.1 | 12.8 | 33.5 |
| 9 | 9.8 | 7.2 | 19.4 | 12.2 | 7.0 | 32.0 |
| 10 | 9.4 | 16.3 | 19.8 | 11.8 | 15.6 | 32.7 |

TABLE 7

| Type | Bonded Magnet: Br (kG) | Bonded Magnet: iHc (kOe) | Bonded Magnet: BHmax (MGOe) | Hot pressed magnet: Br (kG) | Hot pressed magnet: iHc (kOe) | Hot pressed magnet: BHmax (MGOe) |
|---|---|---|---|---|---|---|
| Invention's Method | | | | | | |
| 11 | 10.0 | 11.4 | 21.8 | 12.5 | 11.3 | 34.3 |
| 12 | 9.1 | 24.6 | 19.2 | 11.4 | 24.1 | 30.0 |
| 13 | 10.0 | 11.8 | 22.0 | 12.5 | 11.7 | 34.7 |
| 14 | 9.2 | 19.8 | 19.7 | 11.5 | 19.0 | 29.7 |
| 15 | 9.6 | 10.7 | 20.1 | 12.0 | 10.8 | 32.8 |
| 16 | 9.6 | 21.6 | 21.2 | 12.0 | 20.5 | 34.0 |
| 17 | 9.7 | 12.7 | 20.6 | 12.2 | 12.5 | 33.8 |
| 18 | 9.7 | 13.5 | 20.7 | 12.1 | 13.2 | 33.6 |
| 19 | 9.7 | 7.0 | 18.8 | 12.1 | 7.1 | 32.1 |
| 20 | 9.2 | 17.5 | 18.7 | 11.5 | 17.0 | 30.2 |

TABLE 8

| Type | Bonded magnet: Br (kG) | Bonded magnet: iHc (kOe) | Bonded magnet: BHmax (MGOe) | Hot pressed magnet: Br (kG) | Hot pressed magnet: iHc (kOe) | Hot pressed magnet: BHmax (MGOe) |
|---|---|---|---|---|---|---|
| Invention's Method | | | | | | |
| 21 | 9.7 | 11.4 | 20.4 | 12.1 | 11.0 | 32.2 |
| 22 | 10.1 | 12.0 | 22.1 | 12.7 | 11.6 | 35.5 |
| 23 | 10.0 | 12.1 | 21.6 | 12.5 | 11.9 | 34.6 |
| 24 | 9.9 | 12.3 | 20.8 | 12.4 | 12.1 | 35.1 |
| 25 | 9.6 | 5.9 | 18.6 | 12.0 | 5.5 | 27.1 |
| 26 | 9.9 | 8.7 | 20.8 | 12.3 | 8.6 | 32.2 |
| 27 | 10.2 | 12.0 | 23.1 | 12.8 | 11.4 | 36.2 |
| 28 | 9.8 | 12.4 | 20.6 | 12.3 | 12.1 | 33.7 |
| Comparative Method | | | | | | |
| 1 | 8.8 | 8.3 | 13.7 | 10.8 | 7.7 | 17.6 |
| 2 | 3.6 | 1.4 | <3 | 5.3 | 0.8 | <3 |

TABLE 9

| Type | Bonded magnet: Br (kG) | Bonded magnet: iHc (kOe) | Bonded magnet: BHmax (MGOe) | Hot pressed Magnet: Br (kG) | Hot pressed Magnet: iHc (kOe) | Hot pressed Magnet: BHmax (MGOe) |
|---|---|---|---|---|---|---|
| Conventional Method | | | | | | |
| 1 | 9.6 | 11.1 | 18.8 | 12.0 | 10.7 | 30.4 |
| 2 | 7.6 | 24.3 | 13.2 | 9.5 | 23.5 | 20.2 |
| 3 | 9.3 | 11.9 | 18.5 | 11.5 | 12.2 | 29.7 |
| 4 | 7.2 | 20.1 | 11.8 | 9.0 | 19.3 | 18.0 |
| 5 | 9.4 | 10.1 | 18.0 | 11.7 | 10.2 | 29.5 |
| 6 | 6.5 | 22.3 | 9.2 | 8.1 | 21.8 | 13.3 |
| 7 | 9.5 | 11.8 | 19.7 | 11.8 | 11.3 | 30.0 |
| 8 | 9.2 | 12.6 | 18.1 | 11.4 | 12.4 | 28.6 |
| 9 | 8.7 | 8.4 | 15.5 | 11.0 | 8.3 | 25.4 |
| 10 | 7.0 | 17.0 | 10.8 | 8.7 | 17.1 | 16.7 |

The results presented in Tables 1–9 demonstrate that the magnetic characteristics of the bonded magnets prepared from the rare earth magnetic powders of Invention Methods 1–28, the processing including a medial annealing step, are superior to those of the bonded magnets prepared from the rare earth magnetic powders of Conventional Methods 1–10 not including medial annealing. In contrast, the bonded magnets prepared from the rare earth magnetic powders of Comparative Methods 1 and 2, which are out of the range of the present invention, have low magnetic characteristics.

The results also demonstrate that the magnetic characteristics of the hot pressed magnets prepared from the rare earth magnetic powders of Invention Methods 1–28, whose processing included medial annealing, are superior to those of the hot pressed magnets prepared from the rare earth magnetic powders of Conventional Methods 1–10 not including medial annealing. In contrast, the hot pressed magnets prepared from the rare earth magnetic powders of Comparative Methods 1 and 2, which are out of the range of the present invention, have low magnetic characteristics.

EXAMPLE 2

The ingots a to j, which were prepared in Example 1, of the R—T—M or R—T—M—A alloy materials having the compositions shown in Table 1 were subjected to homogenization under the conditions shown in Table 10, and the resulting homogenized ingots A–J were pulverized blocks or powders having the sizes shown in Table 10. These blocks and powders were subjected to heating, hydrogenation, medial annealing, dehydrogenation, and cooling as in Invention Methods 1–28, Comparative Methods 1–2, and Conventional Methods 1–10 in Example 1, and pulverized powders of a particle size of 300 μm or less. The rare earth magnetic powders of Invention Methods 29–56, Comparative Methods 3–4, and Conventional Methods 11–20 were prepared in such a manner. Bonded magnets and hot pressed magnets were prepared from the resulting rare earth magnetic powders as described in Example 1. The magnetic characteristics of the resulting bonded magnets and hot pressed magnets are shown in Tables 11–14.

TABLE 10

| Type | Used ingot | Conditions of homogenization: Holding temp. (° C.) | Holding time (hr.) | Atmosphere | Size of block or powder |
|---|---|---|---|---|---|
| Homogenized ingot | | | | | |
| A | a | 1,140 | 20 | 1-atm. Ar | <15 mm |
| B | b | 1,120 | 30 | Vacuum | <5 mm |
| C | c | 1,130 | 15 | 1-atm. Ar | <8 mm |
| D | d | 1,110 | 40 | Vacuum | <500 μm |
| E | e | 1,120 | 30 | 2-atm. Ar | <500 μm |
| F | f | 1,140 | 20 | 1-atm. Ar | <10 μm |
| G | g | 1,150 | 5 | Vacuum | <20 mm |
| H | h | 1,100 | 20 | 1-atm. Ar | <400 μm |
| I | i | 1,140 | 15 | 1-atm. Ar | <30 mm |
| J | j | 1,130 | 30 | 1.5-atm. Ar | <15 mm |

TABLE 11

| Type | Homogenized ingot | Heating | Hydrogen Occlusion | Medial annealing | Dehydrogenation |
|---|---|---|---|---|---|
| Invention's Method | | | | | |
| 29 | A | The same as Invention's Method 1 in Example 1 | | | |
| 30 | B | The same as Invention's Method 2 in Example 1 | | | |
| 31 | C | The same as Invention's Method 3 in Example 1 | | | |
| 32 | D | The same as Invention's Method 4 in Example 1 | | | |
| 33 | E | The same as Invention's Method 5 in Example 1 | | | |
| 34 | F | The same as Invention's Method 6 in Example 1 | | | |
| 35 | G | The same as Invention's Method 7 in Example 1 | | | |
| 36 | H | The same as Invention's Method 8 in Example 1 | | | |
| 37 | I | The same as Invention's Method 9 in Example 1 | | | |
| 38 | J | The same as Invention's Method 10 in Example 1 | | | |

TABLE 12

| Type | Homogenized ingot | Heating | Hydrogen Occlusion | Medial annealing | Dehydrogenation |
|---|---|---|---|---|---|
| Invention's Method | | | | | |
| 39 | A | The same as Invention's Method 11 in Example 1 | | | |
| 40 | B | The same as Invention's Method 12 in Example 1 | | | |
| 41 | C | The same as Invention's Method 13 in Example 1 | | | |
| 42 | D | The same as Invention's Method 14 in Example 1 | | | |
| 43 | E | The same as Invention's Method 15 in Example 1 | | | |
| 44 | F | The same as Invention's Method 16 in Example 1 | | | |
| 45 | G | The same as Invention's Method 17 in Example 1 | | | |
| 46 | H | The same as Invention's Method 18 in Example 1 | | | |
| 47 | I | The same as Invention's Method 19 in Example 1 | | | |
| 48 | J | The same as Invention's Method 20 in Example 1 | | | |

TABLE 13

| Type | Homogenized ingot | Heating | Hydrogen Occlusion | Medial annealing | Dehydrogenation |
|---|---|---|---|---|---|
| Invention's Method | | | | | |
| 49 | C | The same as Invention's Method 21 in Example 1 | | | |
| 50 | C | The same as Invention's Method 22 in Example 1 | | | |
| 51 | C | The same as Invention's Method 23 in Example 1 | | | |
| 52 | C | The same as Invention's Method 24 in Example 1 | | | |
| 53 | C | The same as Invention's Method 25 in Example 1 | | | |
| 54 | C | The same as Invention's Method 26 in Example 1 | | | |
| 55 | C | The same as Invention's Method 27 in Example 1 | | | |
| 56 | C | The same as Invention's Method 28 in Example 1 | | | |
| Comparative Method | | | | | |
| 3 | C | The same as Comparative Method 1 in Example 1 | | | |
| 4 | C | The same as Comparative Method 2 in Example 1 | | | |

TABLE 14

| Type | | Homogenized ingot | Heating | Hydrogen Occlusion | Medial annealing | dehydroenation |
|---|---|---|---|---|---|---|
| Conventional Method | 11 | A | The same as Conventional Method 1 in Example 1 | | | |
| | 12 | B | The same as Conventional Method 2 in Example 1 | | | |
| | 13 | C | The same as Conventional Method 3 in Example 1 | | | |
| | 14 | D | The same as Conventional Method 4 in Example 1 | | | |
| | 15 | E | The same as Conventional Method 5 in Example 1 | | | |
| | 16 | F | The same as Conventional Method 6 in Example 1 | | | |
| | 17 | G | The same as Conventional Method 7 in Example 1 | | | |
| | 18 | H | The same as Conventional Method 8 in Example 1 | | | |
| | 19 | I | The same as Conventional Method 9 in Example 1 | | | |
| | 20 | J | The same as Conventional method 10 in Example 1 | | | |

TABLE 15

| Type | Bonded magnet Br (kG) | iHc (kOe) | BHmax (MGOe) | Hot pressed magnet Br (kG) | iHc (kOe) | BHmax (MGOe) |
|---|---|---|---|---|---|---|
| Invention's Method | | | | | | |
| 29 | 10.4 | 11.4 | 23.1 | 13.1 | 11.1 | 38.8 |
| 30 | 9.3 | 31.6 | 19.8 | 11.7 | 30.5 | 31.5 |
| 31 | 10.4 | 12.6 | 24.0 | 13.2 | 12.6 | 40.1 |
| 32 | 9.5 | 24.3 | 20.6 | 12.0 | 23.7 | 33.6 |
| 33 | 10.1 | 10.6 | 22.7 | 12.7 | 10.2 | 35.4 |
| 34 | 9.6 | 21.5 | 19.5 | 12.1 | 21.6 | 34.2 |
| 35 | 10.3 | 12.3 | 23.7 | 12.9 | 11.8 | 36.5 |
| 36 | 9.9 | 12.8 | 21.6 | 12.4 | 12.5 | 34.3 |
| 37 | 10.0 | 8.7 | 20.7 | 12.6 | 8.3 | 34.7 |
| 38 | 9.7 | 18.5 | 20.1 | 12.1 | 17.8 | 33.0 |

TABLE 16

| Type | Bonded magnet Br (kG) | iHc (kOe) | BHmax (MGOe) | Hot pressed magnet Br (kG) | iHc (kOe) | BHmax (MGOe) |
|---|---|---|---|---|---|---|
| Invention's Method | | | | | | |
| 39 | 10.2 | 12.3 | 23.3 | 12.8 | 12.4 | 36.1 |
| 40 | 9.4 | 27.5 | 20.2 | 11.8 | 26.4 | 32.5 |
| 41 | 10.3 | 12.3 | 23.6 | 13.0 | 12.1 | 37.6 |
| 42 | 9.5 | 22.1 | 20.5 | 11.9 | 21.6 | 32.5 |
| 43 | 9.8 | 10.8 | 20.7 | 12.3 | 10.4 | 34.0 |
| 44 | 9.9 | 23.7 | 22.0 | 12.5 | 22.8 | 35.4 |
| 45 | 10.0 | 13.3 | 22.7 | 12.6 | 13.4 | 35.0 |
| 46 | 9.9 | 13.1 | 21.6 | 12.4 | 13.0 | 34.7 |
| 47 | 9.9 | 8.4 | 20.4 | 12.3 | 8.2 | 32.2 |
| 48 | 9.4 | 17.3 | 19.1 | 11.8 | 17.1 | 31.1 |

TABLE 17

| Type | Bonded magnet Br (kG) | iHc (kOe) | BHmax (MGOe) | Hot pressed magnet Br (kG) | iHc (kOe) | BHmax (MGOe) |
|---|---|---|---|---|---|---|
| Invention's Method | | | | | | |
| 49 | 9.9 | 12.0 | 21.6 | 12.4 | 11.8 | 34.5 |
| 50 | 10.5 | 12.2 | 24.7 | 13.2 | 12.1 | 39.8 |
| 51 | 10.3 | 12.5 | 23.1 | 12.9 | 12.5 | 37.6 |
| 52 | 10.2 | 12.5 | 22.8 | 12.8 | 12.3 | 37.0 |
| 53 | 9.8 | 7.6 | 20.6 | 12.3 | 7.5 | 32.0 |

TABLE 17-continued

| Type | Bonded magnet Br (kG) | iHc (kOe) | BHmax (MGOe) | Hot pressed magnet Br (kG) | iHc (kOe) | BHmax (MGOe) |
|---|---|---|---|---|---|---|
| 54 | 10.1 | 10.4 | 23.0 | 12.6 | 9.6 | 35.1 |
| 55 | 10.4 | 12.7 | 24.5 | 13.0 | 11.8 | 37.2 |
| 56 | 9.9 | 12.5 | 20.7 | 12.4 | 12.1 | 33.4 |
| Comparative Method | | | | | | |
| 3 | 8.7 | 7.8 | 14.2 | 9.8 | 6.7 | 16.7 |
| 4 | 4.1 | 2.0 | <3 | 5.4 | 0.5 | <3 |

TABLE 17

| Type | Bonded magnet Br (kG) | iHc (kOe) | BHmax (MGOe) | Hot pressed magnet Br (kG) | iHc (kOe) | BHmax (MGOe) |
|---|---|---|---|---|---|---|
| Invention's Method | | | | | | |
| 49 | 9.9 | 12.0 | 21.6 | 12.4 | 11.8 | 34.5 |
| 50 | 10.5 | 12.2 | 24.7 | 13.2 | 12.1 | 39.8 |
| 51 | 10.3 | 12.5 | 23.1 | 12.9 | 12.5 | 37.6 |
| 52 | 10.2 | 12.5 | 22.8 | 12.8 | 12.3 | 37.0 |
| 53 | 9.8 | 7.6 | 20.6 | 12.3 | 7.5 | 32.0 |
| 54 | 10.1 | 10.4 | 23.0 | 12.6 | 9.6 | 35.1 |
| 55 | 10.4 | 12.7 | 24.5 | 13.0 | 11.8 | 37.2 |
| 56 | 9.9 | 12.5 | 20.7 | 12.4 | 12.1 | 33.4 |
| Comparative Method | | | | | | |
| 3 | 8.7 | 7.8 | 14.2 | 9.8 | 6.7 | 16.7 |
| 4 | 4.1 | 2.0 | <3 | 5.4 | 0.5 | <3 |

The results shown in Tables 10–18 demonstrate that the magnetic characteristics of the bonded magnets prepared from the rare earth magnetic powders of Invention Methods 29–56, in which these rare earth magnetic powders were obtained by annealing, hydrogenation, medial annealing, dehydrogenation, cooling and pulverizing of the homogenized ingots A–J as in Example 1 and had sizes of 300 $\mu$m or less, are superior to those of the bonded magnets prepared from the rare earth magnetic powders of Conventional Methods 11–20 not including medial annealing. In contrast, the bonded magnets prepared from the rare earth magnetic powders of Comparative Methods 3–4, which are out of the range of the present invention, have slightly low magnetic characteristics.

These results also demonstrate that the magnetic characteristics of the hot pressed magnets prepared from the rare earth magnetic powders of Invention Methods 29–56 including medial annealing are superior to those of the hot pressed magnets prepared from the rare earth magnetic powders of Conventional Methods 11–20 not including medial annealing. In contrast, the hot pressed magnets prepared from the rare earth magnetic powders of Comparative Methods 3–4, which are out of the range of the present invention, have slightly low magnetic characteristics.

Advantages

It is clear from the description above that the method of the present invention for manufacturing rare earth magnetic powders, in which a medial annealing treatment is employed between a hydrogenation treatment and a dehydrogenation treatment, produces a rare earth magnetic powder having improved magnetic characteristics over rare earth magnetic powders prepared by conventional methods. Thus the present invention provides a significant industrial advantage in the technology of rare earth metal magnetic powders.

Obviously, numerous modifications and variations of the present invention are possible in light of the above teachings. It is, therefore, to be understood that within the scope of the appended claims, the invention may be practiced otherwise than as specifically described herein.

What is claimed as new and is desired to be secured by Letters Patent is:

1. A method for manufacturing a rare earth magnetic powder having a recrystallization texture of fine $R_2T_{14}M$ intermetallic compound phases and having high magnetic anisotropy, the rare earth magnetic powder comprising an alloy material (R—T—M alloy), wherein R is at least one rare earth metal including Y, T is Fe or an Fe component partially replaced by Co or Ni, M is B or a B component partially replaced by C as primary components;

the method comprising:

heating the R—T—M alloy material from room temperature to a specific temperature of less than 500° C. in a non-oxidizing atmosphere and optionally holding the alloy at this temperature;

performing a hydrogenation treatment of the R—T—M alloy material by holding the R—T—M alloy material at a specific temperature in the range of 500–1,000° C. in a hydrogen atmosphere or a mixed gas atmosphere of hydrogen and an inert gas to promote phase transformation of the R—T—M alloy material by hydrogenation;

performing medial annealing by holding the R—T—M alloy material after the hydrogenation treatment at a specific temperature in the range of 500–1,000° C. in an inert gas atmosphere; and performing dehydrogenation by holding the R—T—M alloy material at a specific temperature in the range of 500 to 1,000° C. in a vacuum atmosphere of a final pressure of less than 1 Torr to promote phase transformation in the R—T—M alloy material by forcibly releasing hydrogen from the R—T—M alloy material, followed by cooling and pulverizing.

2. A method for manufacturing a rare earth magnetic powder having a recrystallization texture of fine $R_2T_{14}M$ intermetallic compound phases and having high magnetic anisotropy, the rare earth magnetic powder comprising an alloy material (R—T—M—A alloy), containing R, T and M as primary components, wherein R is at least one rare earth metal including Y, T is Fe or an Fe component partially replaced by Co or Ni, M is B or a B component partially replaced by C as primary components, and 0.001–5 atomic percent of at least one element (A) selected from the group consisting of Si, Ga, Zr, Nb, Mo, Hf, Ta, W, Al, Ti and V;

the method comprising:

heating the R—T—M—A alloy material from room temperature to a specific temperature of less than 500° C. in a non-oxidizing atmosphere and optionally holding the alloy at this temperature;

performing hydrogenation of the R—T—M—A alloy material by holding the R—T—M—A alloy material at a specific temperature in a range of 500–1,000° C. in a hydrogen atmosphere or a mixed gas atmosphere of hydrogen and an inert gas to promote phase transformation of the R—T—M—A alloy material by hydrogenation;

performing medial annealing by holding the R—T—M—A alloy material after the hydrogenation treatment at a given temperature in the range of 500–1,000° C. in an inert gas atmosphere; and performing dehydrogenation by holding the R—T—M—A alloy material at a specific temperature in the range of 500–1.000° C. in a vacuum atmosphere of a final pressure of less than 1 Torr to promote phase transformation in the R—T—M—A alloy material by forcibly releasing hydrogen from the R—T—M—A alloy material, followed by cooling and pulverizing.

3. A method for manufacturing a rare earth magnetic powder having a recrystallization texture of fine $R_2T_{14}M$ intermetallic compound phases and having high magnetic anisotropy, comprising;

heating an R—T—M alloy material, which is homogenized at a temperature of 600–1,200° C. in a vacuum or Ar gas atmosphere, from room temperature to a specific temperature of less than 500° C. in a nonoxidizing atmosphere and optionally holding the alloy at this temperature;

performing hydrogenation of the R—T—M alloy material by holding the R—T—M alloy material at a given temperature in a range of 500–1,000° C. in a hydrogen atmosphere or a mixed gas atmosphere of hydrogen and an inert gas to promote phase transformation of the R—T—M alloy material by hydrogenation;

performing medial annealing by holding the R—T—M alloy material after the hydrogenation treatment at a specific temperature in the range of 500–1,000° C. in an inert gas atmosphere; and performing dehydrogenation by holding the R—T—M alloy material at a given temperature in the range of 500–1,000° C. in a vacuum of a final pressure of less than 1 Torr to promote phase transformation in the R—T—M alloy material by forcibly releasing hydrogen from the R—T—M alloy material, followed by cooling and pulverizing.

4. A method for manufacturing a rare earth magnetic powder having a recrystallization texture of fine $R_2T_{14}M$ intermetallic compound phases and having high magnetic anisotropy, comprising;

heating an R—T—M—A alloy material, which is homogenized at a temperature of 600–1,200° C. in a vacuum or Ar gas atmosphere, from room temperature to a specific temperature of less than 500° C. in a non-oxidizing atmosphere and optionally holding the alloy at this temperature;

performing hydrogenation of the R—T—M—A alloy material by holding the R—T—M—A alloy material at a specific temperature in the range of 500–1,000° C. in a hydrogen atmosphere or a mixed gas atmosphere of hydrogen and an inert gas to promote phase transformation of the R—T—M—A alloy material by hydrogenation;

performing medial annealing by holding the R—T—M—A alloy material after hydrogenation at a specific temperature in the range of 500–1,000° C. in an inert gas atmosphere; and performing dehydrogenation by holding the R—T—M—A alloy material at a specific temperature in the range of 500–1,000° C. in a vacuum atmosphere of a final pressure of less than 1 Torr to promote phase transformation in the R—T—M—A alloy material by forcibly releasing hydrogen from the R—T—M—A alloy material, followed by cooling and pulverizing.

5. The method of claim 1, wherein the inert gas atmosphere in the medial annealing is an inert gas atmosphere having a pressure in a range of 0.5–11 atm.

6. The method of claim 2, wherein the inert gas atmosphere in the medial annealing is an inert gas atmosphere having a pressure in a range of 0.5–11 atm.

7. The method of claim 3, wherein the inert gas atmosphere in the medial annealing is an inert gas atmosphere having a pressure in a range of 0.5–11 atm.

8. The method of claim 4, wherein the inert gas atmosphere in the medial annealing is an inert gas atmosphere having a pressure in a range of 0.5–11 atm.

9. A method for manufacturing a rare earth magnet, comprising:

binding a rare earth magnetic powder, which is prepared by the method described in claim 1 and has a recrystallization texture of fine $R_2T_{14}M$ intermetallic compound phases and high magnetic anisotropy, with an organic binder or a metallic binder.

10. A method for manufacturing a rare earth magnet, comprising:

binding a rare earth magnetic powder, which is prepared by the method described in claim 2 and has a recrystallization texture of fine $R_2T_{14}M$ intermetallic compound phases and high magnetic anisotropy, with an organic binder or a metallic binder.

11. A method for manufacturing a rare earth magnet, comprising:

binding a rare earth magnetic powder, which is prepared by the method described in claim 3 and has a recrystallization texture of fine $R_2T_{14}M$ intermetallic compound phases and high magnetic anisotropy, with an organic binder or a metallic binder.

12. A method for manufacturing a rare earth magnet, comprising:

binding a rare earth magnetic powder, which is prepared by the method described in claim 4 and has a recrystallization texture of fine $R_2T_{14}M$ intermetallic compound phases and high magnetic anisotropy, with an organic binder or a metallic binder.

13. A method for manufacturing a rare earth magnet, comprising:

preparing a green compact of a rare earth magnetic powder, which is obtained by a method described in claim 1, and hot-pressing or hot-isostatic pressing the green compact at a temperature of 600–900° C.

14. A method for manufacturing a rare earth magnet, comprising:

preparing a green compact of a rare earth magnetic powder, which is obtained by a method described in claim 2, and hot-pressing or hot-isostatic pressing the green compact at a temperature of 600–900° C.

15. A method for manufacturing a rare earth magnet, comprising:

preparing a green compact of a rare earth magnetic powder, which is obtained by a method described in claim 3, and hot-pressing or hot-isostatic pressing the green compact at a temperature of 600–900° C.

16. A method for manufacturing a rare earth magnet, comprising:

preparing a green compact of a rare earth magnetic powder, which is obtained by a method described in claim 4, and hot-pressing or hot-isostatic pressing the green compact at a temperature of 600–900° C.

* * * * *